United States Patent [19]

Lee

[11] Patent Number: 4,735,345

[45] Date of Patent: Apr. 5, 1988

[54] WATER SUPPLY DEVICE OF VACUUM BOTTLE

[76] Inventor: Fu-Kuei Lee, P.O. Box 10780, Taipei, Taiwan

[21] Appl. No.: 855,830

[22] Filed: Apr. 24, 1986

[51] Int. Cl.[4] ..... B67D 5/60

[52] U.S. Cl. ..... 222/131; 222/146.5; 222/333; 222/385

[58] Field of Search ..... 417/420, 424; 222/129, 222/130–131, 173, 182–183, 146.5, 333, 376–377, 382, 383, 385, 405, 410, 464

[56] References Cited

U.S. PATENT DOCUMENTS

| | | | |
|---|---|---|---|
| 958,871 | 5/1910 | Helmer | 222/377 X |
| 3,119,531 | 1/1964 | Jacobs | 417/420 X |
| 3,321,081 | 5/1967 | Willinger | 417/420 X |
| 3,523,629 | 8/1970 | Chi | 222/385 X |
| 3,726,443 | 4/1973 | Harris | 222/333 |
| 3,806,004 | 4/1974 | Kolkovsky | 222/385 |
| 4,060,182 | 11/1977 | Kikuchi | 222/333 |
| 4,408,891 | 10/1983 | Schirk et al. | 417/420 X |
| 4,537,332 | 8/1985 | Brown et al. | 222/190 |

FOREIGN PATENT DOCUMENTS

| | | | |
|---|---|---|---|
| 32865 | 3/1979 | Japan | 222/131 |

*Primary Examiner*—Michael S. Huppert

[57] ABSTRACT

A water supply device for vacuum bottle used a space at the bottom outside the inner bottle to install a power driving device to drive a gear. The gear has two magnetic poles provided by a permanent magnetic iron using to repel or attract the other magnetic poles located at the concavity to rotate. These poles use the same shaft with a multiple blade gear, therefore, as the magnetic poles rotate, the water inside the inner bottle can be squeezed and flow out through outlet pipe.

1 Claim, 2 Drawing Sheets

WATER SUPPLY DEVICE OF VACUUM BOTTLE

BRIEF SUMMARY OF THE INVENTION

The present invention relates to a simple-structured water supply device has a motor driving a circular gear and making the magnetic poles which located at the rim of the circular geat to lead the other magnetic poles of the inner bottle and rotating a multiple flade, thus, the water can be squeezed out.

BACKGROUND OF THE INVENTION

Traditional vacuum bottle no more than the types of lifting the bottle with hand to pour water and of pressing the vacuum bottle with hand to take water.

The disadvantage of traditional vacuum bottle is much dangerous to children and inconvenient to patients because users have to repeatedly rotate the cover for pouring water and then close the cover. Although a air pressure type vacuum bottle designed to overcome the aforesaid defect and doesn't need to lift the bottle and the action to open/close the cover for pouring water, users still need to press the cover by force. In short words, a air pressure type vacuum bottle still cannot avoid the defects of inconventional and danger in falling the bottle.

One more type of electrical vacuum bottle has a motor inside the cover of the bottle and a long axle through the cover to the bottom of the bottle. The motor drives the axle and users suck the water at the bottom of the bottle. The device needs a coupling, a high negative pressure impeller and a long axle thus makes the structure very complicated and rises the gravity center point. You can see the defects of danger in explosion and electricity leakage is still cannot avoid completely.

PURPOSES OF THE INVENTION

The major purpose of the invention is to overcome the defects of danger, inconvenience, and complicated structure of the traditional vacuum bottles.

The second purpose of the invention is to provide a simple-structured device can be assembled easily for vacuum bottles.

Another purpose of the invention is to provide an electrical water supply device of vacuum bottle and let user take the hot water only to touch the button.

To achieve the above purposes, a motor installed at the space of the inner bottle's outside bottom to rotate a gear. The gear has permanent magnets providing several magnetic poles to repel or attract those of the other permanent magnets located at the inner bottle. Thus, the water of the inner bottle can be squeezed out through an outlet pipe.

DETAILED DESCRIPTION OF THE PREFERRED EMBODIMENTS

Figure 1:
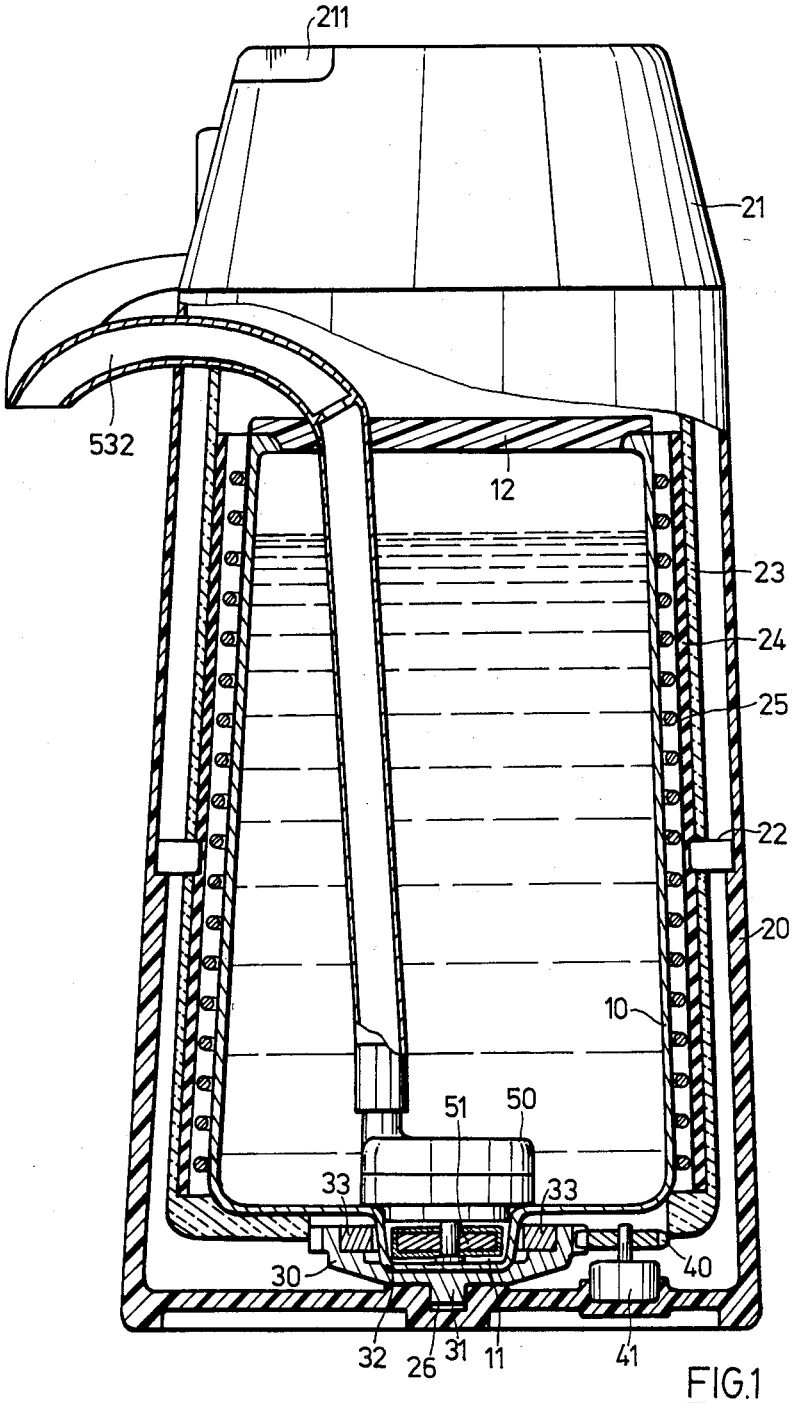
FIG. 1 is a section view of the invention.
Figure 2:
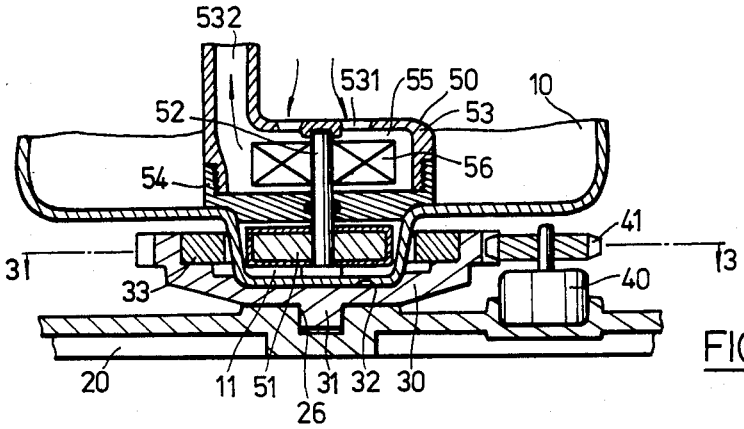
FIG. 2 is a portional section view of the invention to show the detailed structure of the invention.

As the Figs. show, the invention has an inner bottle 10 installing a concavity 11 at the middle of the bottom and an inner cover 12 at the exit of the upper end. The inner bottle 10 which made of stainless steel or equivalent materials is used for store drinking water and is encircled with a heat insulation layer 23 or is installed a high electrical resistance heating coil 25, as FIG. 1 shows, outside the inner bottle 10 to keep the water temperature. Moreover, an electrical in insulation layer 24 is installed between the heating coil 25 and the heat insulation layer 23, so that this invention becomes a heating type vacuum bottle. The inner bottle 10, electrical insulation layer 24, and heat insulation layer 23 are supported on the shoulder inside the outer bottle 20 with a pair of brace 22.

The aforesaid device is not what the invention claims, but mentioned herein to clarify that this invention also equips heating device as general vacuum bottles do.

The characteristics of this invention is in the structure and functions that listed below:

In the center of the outer bottle's bottom there is an axle hole 26 insetted a gear 30. The center of the gear's lower end there is a bulgy axle 31 which is used to inset the axle hole 26 and the upper end of the gear installed a dented ring 32 whose circle is slightly larger than the outside diameter of the inner bottle's concavity 11 so that the gear 30 can be fixed due to the pivot between the dented ring 32 and the concavity's outer rim and that of the axle hole 26 and the bulgy axle 31 and can be rotated by the drive gear 40. The gear 30 is made of molybdenum disulfide nylon or other equivalent materials with high abrasive resistance and low friction coefficient. As the gear 30 is rotating, it can keep around 300 RPM under appropriate transmission ratio and it does not rotate all the time but only rotating during the short period of water taking. Thus, the gear transmission device the invention provided can retain a good condition for long time usage.

Figure 3:
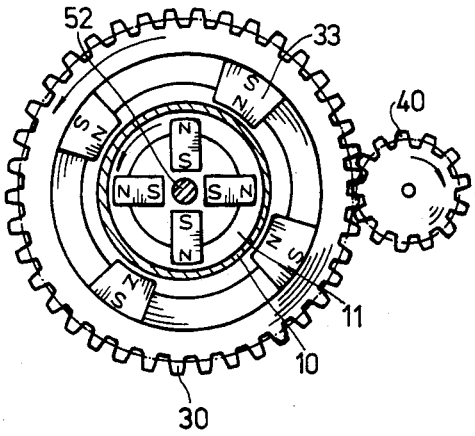
FIG. 3 is a top view from the line 3—3 of the FIG. 2 to show the gear transmission structure.

The drive gear 40 is driven by a speed reduced motor 41 which is adapted inside the outer bottle 20 and the power is controlled by the switch 211 which can be a touch type or a press type located at the front end of the outer cover 21. As FIG. 3 shows, there are several magnetic poles 33 alternately installed at the tooth base of the aforesaid gear 30. As the drive gear 40 drives the gear 30 to rotate, all magnetic poles 33 will be driven to rotate. Since the inner bottle 10 is made of the magnetism-through-material, the magnetic force line can pass through the inner bottle 10 and enter the concavity 11 of the inner bottle 10. Therefore, another set of passive magnetic poles 51 can be repelled or attracted by magnetic force and rotates with magnetic pole 33 of the outer rim accordingly.

The passive poles 51 are fixed at the lower end of a rotating shaft 52 which is pivoted at the center of the pump 50. The pump is comprised of a upper frame 53 with several water inlet holes 531 at its upper edge, a water outlet pipe 532 connects outer with the upper frame 53, and a space 55 formed by the lower edge of the upper frame 53 and the lower frame 54. The shaft 52 vertically passes through space 55 and pivots with the upper frame 53 and the lower frame 54.

There is a multiple blade 56 fixed in position on the rotating shaft 52 just in the space 55. Obviously, the multiple blade 56 rotates together with the passive magnetic poles 51, which are located at the lower edge of the lower frame 54, because of the linking of the shaft 52.

Figure 4:
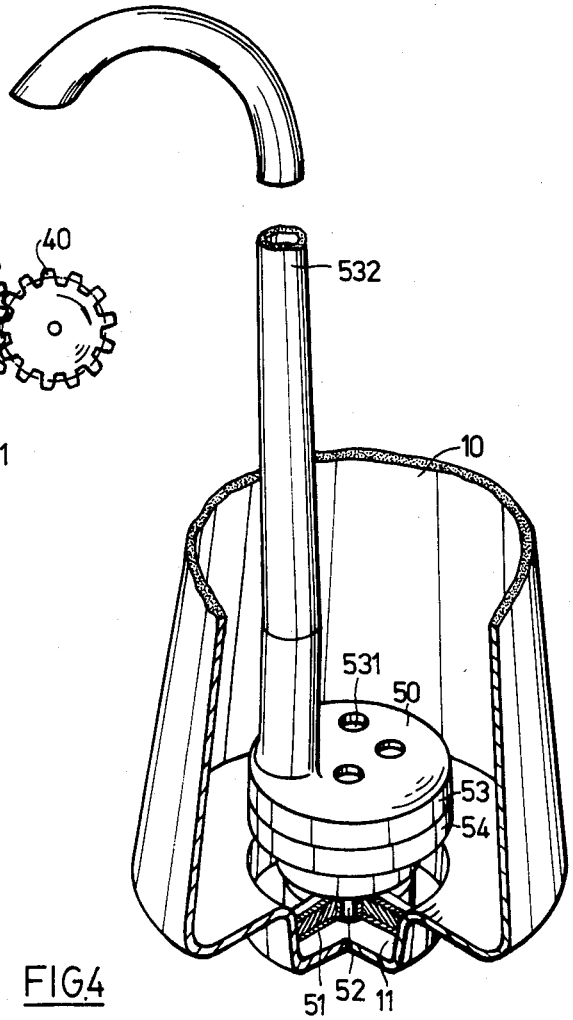
FIG. 4 is a portional isometric view to show that the suction pipe of the invention can be easily pulled out for cleaning.

The components of the pump 50, as the FIG. 4 shows, consists of the upper frame 53, lower frame 54, and the passive magnetic poles 51 which can be disassembled conveniently from the concavity 11 of the inner bottle 10. The water outlet pipe 532, passing through the inner cover 12 of the inner bottle 10 and extending outside the outer bottle 20, has the fixation function with respect to the pump's assembly 50. Furthermore, the pump 50 can be removed easily from the inner bottle 10 just lifting the water outlet pipe 532 so as to facilitate the cleaning work of the pump 50 and the inner bottle 10.

Both of the switch 211 and the speed reduced motor 51 are connected with the power resource so as to the drive gear 40 driving the gear 30 to rotate when the switch 211 powers on the speed reduced motor 51 by being touched or pressed. The magnetic force line of the magnetic poles 33 may attract or repell the passive magnetic poles 51 and make the multiple blade 56 which connected with the passive magnetic poles 51 to rotate, thus, due to the centrifugal force producing by the multiple blade 56 the water in the inner bottle 10 will be sucked from the water intake 531 and flows through the water outlet pipe 532 and reaches the purpose for taking water.

I claim:

1. A water supply device for a vacuum bottle comprising:

an inner bottle formed with a concavity in its bottom;

an outer bottle having a top and enclosing said inner bottle;

a switch installed on the top of the outer bottle for the purpose of switching on and off an electrical power source for a motor;

a rotary gear located between said inner and outer bottles;

a motor used to drive said rotary gear;

said rotary gear having an upstanding peripheral rim and several magnetic poles spaced about an inner surface of said rim, said gear encircling the concavity of said inner bottle;

said inner bottle concavity is a magnetism transmissible concavity and is located in the middle of the bottom of said inner bottle;

a pump provided in the concavity of said inner bottle and having a shaft, a set of passive magnetic poles linked to said shaft, and multiple blades which are linked to and rotated with said shaft;

said pump having a plurality of water intakes communicating with said inner bottle and a water outlet pipe extending from said inner container outwardly of said outer bottle;

whereby when the motor is actuated by said electrical power source switch and said rotary gear surrounding the concavity is rotated, the magnetic flux of said gear's magnetic poles is transmitted through said inner bottle concavity to make the magnetic poles on said pump shaft rotate, thus, rotating the multiple blades to force the water contained in said inner bottle out through the outlet pipe which extends out through said outer bottle.

* * * * *